United States Patent [19]

Culling

[11] 4,135,919

[45] Jan. 23, 1979

[54] ALLOY RESISTANT TO SULFURIC ACID CORROSION

[75] Inventor: John H. Culling, Kirkwood, Mo.

[73] Assignee: Carondelet Foundry Company, St. Louis, Mo.

[21] Appl. No.: 899,826

[22] Filed: Apr. 25, 1978

[51] Int. Cl.[2] ..... C22C 38/42; C22C 38/48

[52] U.S. Cl. ..... 75/122; 75/134 C; 75/134 F

[58] Field of Search ..... 75/122, 134 C, 134 F

[56] References Cited

U.S. PATENT DOCUMENTS

| | | | |
|---|---|---|---|
| 2,553,330 | 5/1951 | Post et al. | 75/122 |
| 3,168,397 | 2/1968 | Scharfstein | 75/128 E |
| 3,759,704 | 9/1973 | Culling | 75/122 |
| 3,844,774 | 10/1974 | Culling | 75/122 |
| 3,947,266 | 3/1976 | Culling | 75/122 |

*Primary Examiner*—Arthur J. Steiner

*Attorney, Agent, or Firm*—Koenig, Senniger, Powers and Leavitt

[57] ABSTRACT

An air-meltable, castable, workable, weldable alloy resistant to corrosion in sulfuric acid over a wide range of acid strengths. The alloy consists essentially of between about 26.00 and about 29.13% by weight nickel, between about 23.32 and about 28.28% by weight chromium, between about 0.66 and about 1.88% by weight molybdenum, between about 2.50 and about 3.82% by weight copper, between about 3.59 and about 4.72% by weight manganese, between about 0.15 and about 1.15% by weight niobium, up to about 1% by weight titanium, up to about 1.0% by weight tantalum, up to about 0.010% by weight boron, up to about 0.5% by weight cobalt, up to about 0.60% by weightsilicon, up to about 0.08% by weight carbon, up to about 0.6% by weight of a rare earth component selected from the group consisting of cerium, lanthanum and misch metal, up to about 0.15% by weight nitrogen, and between about 33.13 and about 39.49% by weight iron.

4 Claims, No Drawings

ALLOY RESISTANT TO SULFURIC ACID CORROSION

BACKGROUND OF THE INVENTION

This invention relates to the field of corrosion-resistant alloys and more particularly to low strategic metal content workable alloys resistant to both oxidizing and reducing sulfuric acid solutions over a wide range of acid concentrations.

For purposes of analyzing and predicting their corrosive effect on various metals, acids and other corrosive agents are commonly classified as either "oxidizing" or "reducing." A reducing medium is one in which the strongest oxidizing agent is the hydrogen ion or hydronium ion while an oxidizing medium includes components which are more highly oxidizing than either the hydrogen ion or hydronium ion. Sulfuric acid is normally a reducing acid but high strength sulfuric acid is often oxidizing, especially at elevated temperatures. Moreover, various industrial sulfuric acid streams contain various oxidizing acids and salts as contaminants. It is, therefore, desirable that an alloy designed for general utility in industrial sulfuric acid streams be resistant to both reducing and oxidizing environments.

Corrosion resistance of any given metal or alloy in a reducing medium is often sharply different from its resistance in an oxidizing medium, with some metals and alloys being more resistant to reducing media and others to oxidizing media. These differences in behavior are thought to be attributable to differences between the corrosion mechanism in a reducing medium and the corrosion mechanism in an oxidizing medium. Thus, corrosive attack by a reducing acid is generally considered to involve attack on the metal by hydrogen ions resulting in the oxidation of metal to soluble ions and release of hydrogen gas. Metals of relatively high nobility, therefore, as indicated by their positions in the galvanic series, are generally resistant to corrosion by reducing acids. Attack by oxidizing media on the other hand does not involve release of hydrogen but commonly results in the formation of metal oxides or other metallic compounds at the metal surface. Unlike the situation with reducing acids, a favorable position relative to hydrogen in the electromotive series provides no insurance that a metal will not be rapidly attacked by an oxidizing medium. However, certain elements such as chromium, aluminum and silicon form tough insoluble oxide films on initial contact with an oxidizing medium and such films serve as barriers against further reaction between the medium and the metal, thus preventing further corrosion from taking place.

Sulfuric acid solutions are not only very corrosive generally but the nature of their corrosive properties varies markedly with both acid concentration and temperature. This variability relates at least in part to sulfuric acid's ambivalent assumption of both reducing and oxidizing properties as its concentration, temperature, and the nature and proportions of various contaminants are altered. As a consequence of this variability in its corrosive properties, few materials are available which are reasonably resistant to sulfuric acid solutions over a wide range of concentrations and temperatures. A relatively large number of available materials exhibit reasonable resistance to either dilute sulfuric acid solutions having an acid strength of less than about 20% by weight or to concentrated solutions having an acid strength greater than 80% by weight. A lesser number of materials are effective for the intermediate and generally more corrosive concentration range of 20–80%, and even fewer metals are commercially useful in contact with sulfuric acid solutions ranging from strengths below 20 to greater than 80%, particularly when exposed to elevated temperatures.

Of the known alloys which are demonstrably effective over wide ranges of sulfuric acid concentrations, many contain relatively high portions of nickel and chromium and are thus rather expensive. There are some known alloys which have no chromium or relatively low chromium contents, but these typically contain from about 16 to 32% molybdenum and up to about 5% tungsten, with less than 7% iron.

Parr U.S. Pat. No. 1,115,239 discloses the first known alloy containing nickel, chromium, molybdenum and copper, a combination now well recognized to be especially resistant to a wide range of sulfuric acid concentrations as well as to many other corrosive media.

LaBour U.S. Pat. No. 2,103,855 recognizes the effectiveness of silicon additions to such alloys in reducing corrosion, but at a drastic loss in ductility, workability and weldability. Silicon, a non-metallic element, has long been used in these alloys to increase hardness, wear resistance, and some ranges of corrosion resistance, but no acceptable way has been discovered to adequately counteract silicon's embrittling effect.

German Pat. No. 304,126 describes the austenitic alloys of about 18% chromium and 8% nickel content, known as the "18-8" stainless steels. Apparently Nekhendze of U.S.S.R. was the first to report on additions of both molybdenum and copper to "18-8" stainless steel in 1931. Thus began a series of iron-base alloys containing nickel, chromium, molybdenum and copper which exhibited advantageous corrosion resistant qualities, but did not equal the more expensive nickel-base alloys.

Research workers for many years have sought to gain the maximum corrosion resistance of nickel-base alloys, such as stainless steel, with the least amount of enrichment by critical alloying metals, i.e., the relatively expensive nonferrous metals which impart improved corrosion properties to the alloy.

One significant development in this series of alloys is described in Parsons U.S. Pat. No. 2,185,987, disclosing what came to be known as Durimet 20, Carpenter 20 or simply Alloy 20, of nominal composition 29% nickel, 20% chromium, 2.5% molybdenum, 3.5% copper, all weight percents, and the balance substantially iron. Alloy 20 has proven to be a standard of comparison against which later alloys are gauged. It possesses a desirable combination of moderately good general corrosion resistance, fine workability, and relatively low strategic alloy content. In terms of cost and relative availability, the elements that are most widely encountered in this family of alloys range as follows in order of increasing cost and decreasing availability: iron, silicon, manganese, copper, chromium, nickel, molybdenum and niobium. Tantalum may substitute for niobium in most cases but at increased cost.

A good deal of work has been done in alloys of this type with the objective of increasing hardness or precipitation hardness. Additional work has been directed to equaling the corrision resistance of Alloy 20 with leaner alloys (alloys of relatively lower critical alloy metal content) or improving upon the resistance of Alloy 20 with the least increase in strategic (critical) alloy metal content. Post U.S. Pat. No. 2,553,330 recognizes the improvement in workability of most types of corrosion resistant alloys brought about by minor additions of cerium or other components of misch metal. Other workers have noted improvements in workability often realized through minor additions of titanium, boron, nitrogen, and niobium either separately or in combinations under certain circumstances.

Scharfstein U.S. Pat. No. 3,168,397 describes alloys exhibiting generally improved resistance to corrosion by sulfuric acid and to stress corrosion cracking. This alloy is somewhat higher in strategic metals than Alloy 20 and nominally contains 32.5% nickel, 20% chromium, 2.3% molybdenum, and 3.3% copper together with one or more of misch metal, niobium, nitrogen, titanium and boron. This alloy is known as Carpenter 20Cb3 and contains about 38% iron compared to about 44% iron in Alloy 20.

Culling U.S. Pat. No. 3,759,704 describes nickel-base alloys of somewhat better general resistance to sulfuric acid solutions than prior nickel-base alloys, and notable for achieving this with increased chromium and reduced nickel contents compared to prior alloys. However, these alloys contain only 4 to 16% iron.

Culling U.S. Pat. No. 3,893,851 maintains a high chromium content but raises nickel to a maximum for increased workability. The alloy of this patent contains only 4% iron.

Culling U.S. Pat. No. 3,844,774 effects reductions in nickel and chromium contents as compared to U.S. Pat. No. 3,759,704, while raising iron to about 25%.

Culling U.S. Pat. No. 3,947,266 describes alloys in which iron is further increased to about 30% without losing sulfuric acid corrosion resistance. However, in view of the increasing scarcity and cost of strategic metals, many of which are imported, there remains the desirability of further reducing strategic metal content without sacrificing corrosion resistance or workability.

SUMMARY OF THE INVENTION

Among the several objects of the present invention, therefore, may be noted the provision of improved alloys resistant to both oxidizing and reducing sulfuric acid solutions; the provision of such alloys which are resistant to sulfuric acid over a wide range of concentrations and temperatures; the provision of such alloys which are resistant to sulfuric acid containing oxidizing contaminants, such as nitric acid; the provision of such alloys which can be cast or wrought; the provision of such alloys which have a low hardness and high ductility so that they may be readily rolled, forged, welded and machined; the provision of such alloys which may be economically formulated with relatively low proportions of strategic metals such as nickel, chromium and molybdenum; and the provision of such alloys whose strategic metal content is sufficiently low so that they may be formulated from such relatively low-cost raw materials as scraps, ferro alloys or other commercial melting alloys. Other objects and features will be in part apparent and in part pointed out hereinafter.

Briefly, therefore, the present invention is directed to an air-meltable, castable, workable, weldable alloy resistant to corrosion and sulfuric acid over a wide range of acid strengths. The alloy consists essentially of between about 26.00 and about 29.13% by weight nickel, between about 23.32 and about 28.28% by weight chromium, between about 0.66 and about 1.88% by weight molybdenum, between about 2.50 and about 3.82% by weight copper, between about 3.59 and about 4.72% by weight manganese, between about 0.15 and about 1.15% by weight niobium, up to about 1% by weight titanium, up to about 1.0% by weight tantalum, up to about 0.010% by weight boron, up to about 0.5% by weight cobalt, up to about 0.60% by weight silicon, up to about 0.08% by weight carbon, up to about 0.6% by weight of a rare earth component selected from a group consisting of cerium, lanthium and misch metal, up to about 0.15% by weight nitrogen and between about 33.13 and about 39.49% by weight iron.

DESCRIPTION OF THE PREFERRED EMBODIMENT

In accordance with the present invention, alloys are provided whose proportions of strategic metals are even lower than those of my earlier U.S. Pat. No. 3,947,266. Despite the low strategic metal content of the alloys of the invention, however, these alloys are highly resistant to corrosion by sulfuric acid over a wide range of concentrations, both in the reducing and in the oxidizing ranges. These alloys retain their corrosion resistance, even at elevated temperatures, and show effective corrosion resistance in the presence of sulfuric acid concentrations of 20–80%, an environment in which rapid failure is frequently experienced in alloys specifically designed for use in either dilute or concentrated acid. This strong resistance to corrosion is retained, moreover, even when the sulfuric acid solution contains oxidizing agents, such as nitric acid.

The outstanding corrosion resistance of the alloys of the invention is attributable in part to the fact that they are single-phase solid solutions having an austenitic (face-centered cubic) structure. Attainment of this structure does not require heat treatment but is realized in the as-cast condition of the alloy. These alloys not only possess low hardness characteristics as-cast but also remain unaffected by precipitation hardening techniques. Even if the alloy is heat treated under conventional age hardening conditions, no precipitation, phase changes or significant changes in hardness are observed.

The essential components of the alloys of the invention are:

| | |
|---|---|
| Nickel | 26.00 – 29.13% |
| Chromium | 23.32 – 28.28% |
| Molybdenum | 0.66 – 1.88% |
| Copper | 2.50 – 3.82% |
| Manganese | 3.59 – 4.72% |
| Niobium | 0.15 – 1.15% |
| Iron | 33.13 – 39.49% |

Normally, the alloys of the invention will also contain carbon, up to a maximum of about 0.08% by weight.

Optionally, the alloys of the invention may further contain:

| | |
|---|---|
| Titanium | up to 1% |
| Tantalum | up to 1.0% |
| Boron | up to 0.010% |
| Cobalt | up to 0.5% |
| Silicon | up to 0.60% |
| Cerium, lanthanum or misch metal | up to 0.6% |
| Nitrogen | up to 0.15% |

It is well recognized that the presence of chromium in iron-based alloys affords resistance to oxidizing media due to rapid initial oxidation of chromium to form a thin film which passivates the alloy against further attack. In accordance with the present invention, it has been discovered that the relatively low strategic metal content alloys of the invention may be effectively passivated by the incorporation of chromium in a range of about 23.32 to about 28.28% by weight. Niobium acts similarly to and together with chromium in passivating these alloys.

Manganese is an important component of the alloys of the invention, since its presence in the range of 3.59–4.72% by weight allows an austenitic structure to be maintained even with the relatively low nickel content of these alloys. For an alloy having the nickel and chromium content specified herein, the influence of manganese in promoting austenitic structure passes through an optimum in the 3.59–4.72% range. Significantly higher proportions may be detrimental, therefore, or at least may necessitate higher proportions of nickel to maintain a face-centered cubic structure.

Manganese in the defined range is not only useful as an austenitizer but also promotes rapid initial oxidation of chromium to provide the passivating layer which affords a high level of resistance to oxidizing media. It has been discovered, for example, that 3.59–4.72% manganese provides markedly advantageous corrosion resistance in 80–92% sulfuric acid at 80° C. Additionally, manganese is a deoxidizing element whose presence helps ensure the provision of gas-free sound metal ingots.

Copper is an essential component of the alloys of the invention whose presence to the extent of at least about 2.50% contributes materially to their corrosion resistance. However, copper in proportions above about 3.82% by weight begins to exhibit a detrimental effect on corrosion resistance.

Use of the hereinabove specified proportions for nickel, chromium, manganese, copper and niobium provides the important advantage of allowing the molybdenum content of the alloy to be maintained at the rather low level of 0.66–1.88% by weight. Many prior art alloys which contain relatively low proportions of nickel and chromium achieve satisfactory corrosion resistance only with considerably higher proportions of molybdenum than are contained in the alloys of the invention. Use of low porportions of molybdenum is not only economically advantageous but avoids the detrimental effect on corrosion under highly oxidizing conditions, and adverse effect on mechanical properties caused by solid solution hardening which may otherwise result from high proportions of molybdenum.

Niobium is effective not only in its cooperation with chromium in passivating the alloys of the invention against attack by oxidizing media, but is also well recognized as a carbide stabilizer. Where the alloy contains carbon, niobium is thus useful in tying the carbon up to prevent the intergranular cracking which carbon may otherwise tend to cause. Susceptibility to intergranular cracking is conventionally limited by solution annealing of carbon containing alloys, but the presence of a stabilizer such as niobium may avoid the necessity of solution heat treatment to prevent cracking in service. Additionally niobium contributes to the hot strength of the alloy.

Titanium and tantalum are also effective carbide stabilizers. Tantalum, like niobium, further contributes to the passivating effect of the chromium.

Although detrimental if present in excessive amounts, carbon is commonly present as a component which can be tolerated to the extent of about 0.08% by weight. A small amount of carbon may be beneficial in enhancing the fabricability of the alloy.

Where carbon is present, there are three alternatives for prevention of intergranular attack. As one alternative, carbon content may be held to very low levels, below the room temperature solubility limit which is about 0.03% by weight maximum. If carbon exceeds the solid solubility limit at service temperatures, the alloy or a product fabricated therefrom may be solution heat treated by holding at elevated temperature, typically about 2000° F., followed by a quench or rapid cooling. Alloys which are employed in a solution annealed condition may have carbon levels on the order of about 0.08% by weight or slightly above. However, subsequent moderately elevated temperature exposure, such as occurs in the region of a weld, may result in resensitization of the alloy to intergranular attack. To avoid problems such as these, a practical method for preventing attack is the inclusion in the alloy of niobium at a minimum content of approximately eight times the carbon content. Alternatively, tantalum at a minimum of 16 times the carbon content or titanium in a weight proportion of at least five times the carbon content may be used. Proportionate combinations of these elements also effectively stabilize the carbon and prevent intergranular attack.

As a carbide stabilizer, niobium is preferred. It is more difficult to avoid titanium oxidation losses during air melting of the alloys than it is to minimize niobium losses; and tantalum has about twice the atomic weight of niobium and about 1¾ times the cost per pound, so that the effective cost of tantalum as a carbide stabilizer is about 3½ times that of niobium.

If the carbon content of the alloy of the invention is at the maximum of about 0.08%, a minimum niobium content of about 0.64% required to stabilize carbides under the conditions where intergranular attack is possible. Slightly higher proportions of stabilizers are desirable under extremely corrosive conditions, or where the alloy is subjected to unusual sensitizing heat conditions prior to exposure.

Niobium has also been found to improve ductility and workability of the alloys of the invention when present in amounts of the order of about 0.5 to about 0.8% by weight. A maximum of about 1.15% by weight niobium has been found to best meet the properties of optimum workability. A minimum of about 0.15% by weight niobium is desired, even when carbon levels are low enough to obviate the need for carbide stabilization.

To provide the high ductility and resistance to age hardening characteristic of the alloys of the invention, it is essential that cobalt be excluded or at least maintained in very low concentrations. Cobalt is a common impurity in nickel sources and some minor amounts of cobalt are commonly present in nickel alloys. It is essential, however, that the cobalt content of the alloys of the invention be no greater than approximately 0.5% by weight.

Nitrogen may also be present as an impurity in the alloys of the invention, especially if they are prepared in the presence of air. A very small amount of nitrogen may actually be beneficial to the ductility and fabricability of the alloys but amounts of nitrogen significantly higher than 0.15% are detrimental and should be avoided.

Minor proportions of rare earth components such as cerium, lanthanum or misch metal are optionally included in the alloys of the invention. Such proportions may contribute to the fabricability of the alloys. The rare earth component should not constitute more than about 0.6% by weight of the alloy, however.

Small additions of boron contribute to the elongation of the alloy and thus its ability to be wrought. Proportions of boron significantly in excess of about 0.010% should be avoided, however, since such higher proportions of boron have a distinctly adverse effect on corrosion resistance.

Silicon can be tolerated in the alloys of the invention up to about 0.60% by weight without adverse effect on the corrosion resistance. Higher proportions of silicon are undesirable since silicon is a hard, brittle, nonmetallic ferrite-forming element which has a very adverse effect on the hardness, ductility, and fabricability of the alloy.

In a preferred embodiment of the invention, the nickel content of the alloy exceeds the chromium content by between about 1.6 and about 2% by weight, and the alloy contains the following components in the indicated ranges of proportions:

| | |
|---|---|
| Nickel | 27 - 29% |
| Chromium | 25 - 27% |
| Molybdenum | 0.66 - 1.8% |
| Copper | 3.2 - 3.8% |
| Manganese | 3.6 - 4.6% |
| Niobium | 0.5 - 0.7% |
| Silicon | 0.3 - 0.4% |
| Carbon | 0.03 - 0.05% |
| Iron | 33 - 38% |

A particularly advantageous alloy having optimum properties in various services has the following composition:

| | |
|---|---|
| Nickel | 28% |
| Chromium | 26% |
| Molybdenum | 1.3% |
| Copper | 3.5% |
| Manganese | 4% |
| Niobium | 0.6% |
| Silicon | 0.3% |
| Carbon | 0.03% |
| Iron | Balance (approximately 36.25%) |

Although the alloys of the invention are of somewhat lower strategic metal content than those of my prior U.S. Pat. No. 3,947,266, the general resistance of the alloys of the invention to corrosion and various sulfuric acid solutions is superior to that of my earlier patent. The alloys of the invention are highly resistant to corrosion by sulfuric acid solutions over a wide range of compositions. They are resistant to both oxidizing and reducing sulfuric acids, and are suitable for use at elevated temperatures with various contaminants in the corrosive solutions. They may be cast or wrought. They have low hardness and high ductility so that they may be readily rolled, forged, welded and machined. They retain all of the castability and workability properties of the alloys described in my earlier U.S. Pat. No. 3,947,266, as well as alloys 20 and 20Cb3 (U.S. Pat. Nos. 2,185,987 and 3,168,397) but with superior corrosion resistance and lower strategic metal content than the best of those prior art alloys.

The alloys of the invention are prepared by conventional methods of melting, and no special conditions, such as controlled atmosphere, special furnace linings, protective slags or special molding materials are required. Because of the relatively low strategic or critical metal content and correspondingly high iron content of these alloys, they may be formulated from relatively low-cost raw materials, such as scrap, ferro alloys or other commercial melting alloys. Despite their high iron content, the alloys of the invention have low magnetic permeabilities consistently below 1.02.

The following examples illustrate the invention.

EXAMPLE 1

One hundred-pound heats of six different alloys were prepared in accordance with the invention. Each of these heats was air-melted in a 100-pound high frequency induction furnace. The composition of these alloys is set forth in Table I, with the balance in each instance being essentially iron.

TABLE I

PERCENT BY WEIGHT OF ALLOYING ELEMENTS

| Alloy Number | Ni | Cr | Mo | Cu | Mn | Si | C | Nb |
|---|---|---|---|---|---|---|---|---|
| 1233 | 27.26 | 23.32 | 1.88 | 2.65 | 3.74 | 0.49 | 0.06 | 1.11 |
| 1242 | 29.13 | 26.98 | 0.84 | 3.67 | 4.15 | 0.30 | 0.03 | 0.19 |
| 1243 | 27.18 | 26.38 | 1.00 | 3.29 | 4.72 | 0.41 | 0.03 | 0.79 |
| 1246 | 26.00 | 28.28 | 1.35 | 3.66 | 3.82 | 0.53 | 0.04 | 0.55 |
| 1247 | 29.12 | 27.56 | 0.66 | 3.82 | 4.57 | 0.40 | 0.03 | 0.71 |
| 1248 | 27.27 | 25.27 | 1.81 | 3.24 | 3.59 | 0.35 | 0.03 | 0.53 |

Standard physical test blocks and corrosion test bars were prepared from each heat. Using the as-cast non-heat-treated physical test blocks, the mechanical properties of each of these alloys were then measured. The results of these measurements are set forth in Table II.

TABLE II

PHYSICAL PROPERTIES OF ALLOYS, AS CAST

| Alloy Number | Tensile Strength P.S.I. | Yield Strength P.S.I. | Tensile Elongation % | Brinell Hardness Number |
|---|---|---|---|---|
| 1233 | 64,430 | 27,530 | 42.5 | 133 |
| 1242 | 66,290 | 28,570 | 49.0 | 126 |
| 1243 | 59,910 | 29,200 | 33.0 | 131 |
| 1246 | 67,540 | 32,780 | 44.0 | 128 |
| 1247 | 55,740 | 31,080 | 25.5 | 118 |
| 1248 | 63,870 | 25,610 | 53.0 | 126 |

Without heat treatment, the corrosion test bars were machined into 1½ inch diameter by ¼ inch thick discs, each having a ⅛ inch diameter hole in the center. Care was exercised during machining to obtain extremely smooth surfaces on the discs. Twelve to 14 discs were obtained for each alloy.

These discs were used in the comparative corrosion tests, described hereinafter, comparing the performance of the alloys of the invention with a number of alloys which either conform to certain prior art references or which are similar to the alloys of the invention but do not satisfy certain of the critical compositional limitations of the alloys of the invention. The compositions of the alloys used in these tests are set forth in Table III.

TABLE III

PERCENT BY WEIGHT ALLOYING ELEMENTS - COMPARATIVE ALLOYS

| Alloy Number | Ni | Cr | Mo | Cu | Mn | Si | C. | Nb |
|---|---|---|---|---|---|---|---|---|
| 982 | 32.35 | 17.59 | 1.83 | 3.35 | 0.41 | 2.14 | 0.05 | — |
| 984 | 32.40 | 20.02 | 2.20 | 3.44 | 1.50 | 1.82 | 0.05 | — |
| 1232 | 26.52 | 22.37 | 1.03 | 2.50 | 3.83 | 0.36 | 0.06 | 0.09 |
| 1234 | 27.20 | 23.07 | 3.77 | 3.11 | 3.64 | 0.60 | 0.06 | 1.95 |
| 1238 | 26.48 | 23.17 | 2.43 | 3.23 | 3.40 | 0.39 | 0.05 | 1.47 |
| 1239 | 26.50 | 23.35 | 3.07 | 3.10 | 3.54 | 0.38 | 0.05 | 1.65 |
| FONTANA 2,214,128 | 27.15 | 20.03 | 3.28 | 3.42 | 2.22 | 0.96 | 0.04 | — |
| CARPENTER 20 | 29.10 | 20.15 | 2.33 | 3.23 | 0.66 | 0.28 | 0.07 | — |
| CARPENTER 20Cb3 | 32.5 | 20.05 | 2.45 | 3.55 | 0.72 | 0.50 | 0.04 | 0.51 |
| ILLIUM 98 | 55.0 | 28.0 | 8.5 | 5.5 | 1.25 | 0.79 | 0.05 | — |
| 971 | 41.56 | 33.94 | 3.16 | 3.63 | 0.60 | 0.81 | 0.07 | — |
| 956 | 46.17 | 25.28 | 8.32 | 4.37 | 1.03 | 0.72 | 0.05 | — |
| 1071 | 55.48 | 33.20 | 3.23 | 2.85 | 1.41 | 0.31 | 0.05 | — |
| 1218 | 30.64 | 28.85 | 3.13 | 3.68 | 3.05 | 0.25 | 0.03 | 0.54 |

In the above table, Carpenter 20 conforms to Parsons U.S. Pat. No. 2,185,987. Number 982 generally conforms to the Parsons patent but is modified to a somewhat higher nickel content. Number 984 is otherwise according to Parsons except modified to a higher chromium content. Number 1232 corresponds to Parsons except that manganese has been increased to the range of the present invention.

The Fontana U.S. Pat. No. 2,214,128 is included along with 1,234,1238 and 1239, which are all variations of Fontana, with niobium additions.

Number 971 is representative of alloys of Culling U.S. Pat. No. 3,759,704, number 956 is typical of Culling U.S. Pat. No. 3,844,774, number 1071 is typical of Culling U.S. Pat. No. 3,893,851 and number 1218 is typical of Culling U.S. Pat. No. 3,947,266.

In these examples Alloy Number 1232 is similar to the alloys of this invention except that the chromium and copper levels are too low. Number 1234 corresponds to the limitations of this invention except that molybdenum and niobium levels are too high, and the chromium level is a little too low. In Alloy Number 1238 the molybdenum and niobium levels are higher, while the manganese and chromium levels are lower than the alloys of this invention. In Alloy Number 1239, the molybdenum and niobium levels are too high, while nickel, chromium and manganese are just about at the minimum side of ranges allowable in alloys of this invention.

Carpenter 20Cb3 is the well-known commercial alloy which corresponds to Schrarfstein U.S. Pat. No. 3,168,397. Illium 98 is a well-known nickel-base alloy used in sulfuric acid solutions.

EXAMPLE 2

Using the disc samples prepared in Example 1, corrosion tests were run in 10%, 25%, 40%, 50%, 60%, 70%, 80%, 93%, and 97% by weight sulfuric acid solutions at 80° C. (176° F.).

In carrying out these tests, each of the discs was cleaned with a small amount of carbon tectrachloride to remove residual machining oil and dirt and the discs were than rinsed in water and dried. Each clean, dry disc was weighed to the nearest 10,000th of a gram and then suspended in a beaker by a piece of thin platinum wire hooked through the center hole of the disc and attached to a glass rod which rested on top of the beaker. Sufficient sulfuric acid solution was then added to the beaker so that the entire sample was immersed. The temperature of the acid was thermostatically controlled at 80° C. by means of a water bath and each beaker was covered with a watch glass to minimize evaporation.

After precisely 6 hours, the sample discs were removed from the sulfuric acid solution and cleaned of corrosion products. Most samples were cleaned sufficiently with a small nylon bristle brush and tap water. Those samples on which the corrosion products were too heavy for removal with a nylon brush were cleaned with a 1:1 solution of hydrochloric acid and water. After the corrosion products had been removed, each disc was again weighed to the nearest 10,000th of a gram. The corrosion rate of each disc, in inches per year, was calculated by the following formula in accordance with ASTM specification Gl-67.

$$R_{ipy} = 0.3937 \frac{W_o - W_f}{ATD}$$

where $R_{ipy}$ = corrosion rate in inches per year
$W_o$ = original weight of sample
$W_f$ = final weight of sample
A = area of sample in square centimeters
T = duration of test in years
D = density of alloy in g/cc Results of these corrosion tests are set forth in Tables IV and V.

TABLE IV

CORROSION RATES IN INCHES OF PENETRATION PER YEAR (I.P.V.) AT 80° C IN VARIOUS SULFURIC ACID-WATER SOLUTIONS

| Alloy Number or Name | 10% by wt. $H_2SO_4$ | 25% by wt. $H_2SO_4$ | 40% by wt. $H_2SO_4$ | 50% by wt. $H_2SO_4$ | 60% by wt. $H_2SO_4$ |
|---|---|---|---|---|---|
| 1233 | NIL | NIL | NIL | NIL | NIL |
| 1242 | NIL | NIL | NIL | NIL | NIL |
| 1243 | NIL | NIL | NIL | NIL | NIL |
| 1246 | NIL | NIL | NIL | NIL | NIL |
| 1247 | NIL | NIL | NIL | NIL | 0.0008 |
| 1248 | NIL | NIL | NIL | NIL | NIL |
| 982 | 0.0284 | 0.0108 | 0.0392 | 0.0084 | 0.0087 |
| 984 | 0.0048 | 0.0186 | 0.0188 | 0.0081 | 0.0092 |
| 1232 | 0.0340 | 0.0140 | 0.0149 | 0.0135 | 0.0051 |

TABLE IV-continued

| CORROSION RATES IN INCHES OF PENETRATION PER YEAR (I.P.V.) AT 80° C IN VARIOUS SULFURIC ACID-WATER SOLUTIONS | | | | | |
|---|---|---|---|---|---|
| Alloy Number or Name | 10% by wt. $H_2SO_4$ | 25% by wt. $H_2SO_4$ | 40% by wt. $H_2SO_4$ | 50% by wt. $H_2SO_4$ | 60% by wt. $H_2SO_4$ |
| 1234 | 0.1658 | 0.2857 | 0.3324 | 0.6008 | 3.1007 |
| 1238 | 0.0119 | NIL | 0.0035 | 0.0081 | 0.0078 |
| 1239 | 0.0348 | 0.0022 | 0.0086 | 0.0092 | 0.0070 |
| FONTANA | 0.0078 | 0.0192 | 0.0151 | 0.0162 | 0.0243 |
| CARPENTER 20 | 0.0045 | 0.0102 | 0.0162 | 0.0174 | 0.0181 |
| CARPENTER 20Cb3 | 0.0041 | 0.0102 | 0.0091 | 0.0083 | 0.0102 |
| ILLUM 98 | 0.0030 | 0.0057 | 0.0048 | 0.0050 | 0.0048 |
| 971 | 0.0008 | 0.0011 | 0.0042 | NIL | 0.0003 |
| 956 | 0.0016 | NIL | NIL | 0.0103 | 0.0086 |
| 1071 | 0.0027 | 0.0030 | 0.0043 | 0.0019 | 0.0005 |
| 1218 | NIL | NIL | NIL | 0.0005 | 0.0143 |

TABLE V

| CORROSION RATES IN INCHES OF PENETRATION PER YEAR (I.P.Y.) AT 80° C IN VARIOUS SULFURIC ACID-WATER SOLUTIONS | | | | | |
|---|---|---|---|---|---|
| Alloy Number or Name | 70% by wt. $H_2SO_4$ | 80% by wt. $H_2SO_4$ | 85% by wt. $H_2SO_4$ | 93% by wt. $H_2SO_4$ | 97% by wt. $H_2SO_4$ |
| 1233 | NIL | 0.0205 | 0.0151 | 0.0027 | 0.0016 |
| 1242 | 0.0108 | 0.0059 | 0.0049 | NIL | 0.0016 |
| 1243 | 0.0068 | 0.0024 | NIL | (0.0074) | 0.0041 |
| 1246 | 0.0073 | 0.0081 | 0.0059 | 0.0111 | 0.0022 |
| 1247 | 0.0084 | 0.0054 | 0.0022 | 0.0078 | 0.0032 |
| 1248 | NIL | 0.0092 | 0.0032 | 0.0057 | 0.0038 |
| 982 | 0.0048 | 0.0103 | 0.0157 | 0.0332 | 0.0073 |
| 984 | 0.0382 | 0.0375 | 0.0342 | 0.0235 | 0.0211 |
| 1232 | 0.0170 | 0.0608 | 0.0518 | 0.0319 | 0.0257 |
| 1234 | 0.4622 | 0.0664 | 0.0467 | 0.1277 | 0.0234 |
| 1238 | 0.0203 | 0.0467 | 0.0367 | 0.0248 | 0.0159 |
| 1239 | 0.0089 | 0.0405 | 0.0440 | 0.0294 | 0.0572 |
| FONTANA | 0.3787 | 0.0245 | 0.0242 | 0.0239 | 0.0208 |
| CARPENTER 20 | 0.037 | 0.037 | 0.033 | 0.023 | 0.021 |
| CARPENTER 20Cb3 | 0.0512 | 0.0191 | 0.0212 | 0.0202 | 0.0173 |
| TLLTUM 98 | 0.0107 | 0.0078 | 0.0056 | 0.0040 | 0.0033 |
| 971 | 0.0068 | 0.0806 | 0.0165 | NIL | 0.0013 |
| 956 | 0.0051 | 0.0357 | 0.0378 | NIL | 0.0040 |
| 1071 | 0.0008 | 0.0578 | 0.0173 | 0.0040 | 0.0019 |
| 1218 | 0.0211 | 0.0097 | 0.0103 | 0.0092 | 0.0054 |

It may be seen from Tables IV and V that the alloys of this invention are substantially equal to or superior to the comparative nickel-chromium-base alloys and generally quite superior to the iron-nickel-chromium-base alloys.

EXAMPLE 3

Since oxidizing contaminants are often present in commercial sulfuric acid streams, the alloys of this invention were tested for resistance to corrosion in such environments. Using the method described in Example 2, comparative corrosion tests were conducted in 10%, 25%, 40%, 50%, 60%, 70% and 75% sulfuric acid solutions, each containing 5% nitric acid at 80° C. The results of these tests are set forth in Table VI.

TABLE VI

| CORROSION RATES IN INCHES PER YEAR (I.P.Y.) PENETRATION AT 80° C FOR VARIOUS SULFURIC ACID-WATER SOLUTIONS PLUS 5% NITRIC ACID | | | | | | | |
|---|---|---|---|---|---|---|---|
| Alloy Number | Sulfuric Acid Strength (% by Weight $H_2SO_4$) | | | | | | |
| | 10% | 25% | 40% | 50% | 60% | 70 | 75% |
| 1233 | NIL | NIL | NIL | NIL | 0.0005 | 0.0049 | 0.0081 |
| 1242 | NIL | NIL | NIL | NIL | 0.0011 | 0.0027 | 0.0041 |
| 1243 | NIL | 0.0014 | 0.0008 | 0.0019 | 0.0027 | 0.0057 | 0.0078 |
| 1246 | 0.0084 | NIL | NIL | NIL | 0.0016 | 0.0035 | 0.0105 |
| 1247 | 0.0041 | NIL | NIL | 0.0011 | 0.0014 | 0.0062 | 0.005 |
| 1248 | NIL | 0.0008 | 0.0019 | NIL | 0.0022 | 0.0049 | 0.0103 |

EXAMPLE 4

Using the method described in Example 2, comparative corrosion tests were conducted on boiling 10%, 25% and 40% sulfuric acid-water solutions containing 5% nitric acid. Results of these tests are set forth in Table VII.

TABLE VII

| CORROSION RATES IN INCHES PER YEAR (I.P.Y.) PENETRATION FOR VARIOUS BOILING SOLUTIONS OF SULFURIC ACID AND WATER PLUS 5% NITRIC ACID | | | |
|---|---|---|---|
| Alloy Number | Sulfuric Acid Strength (% by Weight) | | |
| | 10% | 25% | 40% |
| 1233 | 0.0005 | NIL | 0.0084 |
| 1242 | 0.0067 | 0.0005 | 0.0046 |
| 1243 | 0.0076 | 0.0043 | 0.0132 |
| 1246 | 0.0022 | 0.0016 | 0.0181 |
| 1247 | 0.0059 | 0.0027 | 0.0132 |
| 1248 | 0.0030 | 0.0027 | 0.0127 |

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable, castable, workable, weldable alloy, resistant to corrosion in sulfuric acid over a wide range of acid strengths, consisting essentially of between about 26.00 and about 29.13% by weight nickel, between about 23.32 and about 28.28% by weight chromium, between about 0.66 and about 1.88% by weight molybdenum, between about 2.50 and about 3.82% by weight copper, between about 3.59 and about 4.72% by weight manganese, between about 0.15 and about 1.15% by weight niobium, up to about 1% by weight titanium, up to about 1.0% by weight tantalum, up to about 0.010% by weight boron, up to about 0.5% by weight cobalt, up to about 0.60% by weight silicon, up to about 0.08% by weight carbon, up to about 0.6% by weight of a rare earth component selected from the group consisting of cerium, lanthanum and misch metal, up to about 0.15% by weight nitrogen, and between about 33.13 and about 39.49% by weight iron.

2. An alloy as set forth in claim 1 wherein the nickel content exceeds the chromium content by between about 1.6 and about 2.0% by weight.

3. An alloy as set forth in claim 2 containing between about 27 and about 29% by weight nickel, between about 25 and about 27% by weight chromium, between about 0.66 and about 1.8% by weight molybdenum, between about 3.2 and 3.8% by weight copper, between about 3.6 and about 4.6% by weight manganese, between about 0.5 and about 0.7% by weight niobium, between about 0.3 and about 0.4% by weight silicon, between about 0.03 and about 0.05% by weight carbon, and between about 33 and 38% by weight iron.

4. An alloy as set forth in claim 3 containing about 28% by weight nickel, about 26% by weight chromium, about 1.3% by weight molybdenum, about 3.5% by weight copper, and 4% by weight manganese, about 0.6% by weight niobium, about 0.3% by weight silicon, about 0.03% by weight carbon, and the balance being essentially iron.

* * * * *

UNITED STATES PATENT AND TRADEMARK OFFICE

CERTIFICATE OF CORRECTION

PATENT NO. : 4,135,919

DATED : January 23, 1979

INVENTOR(S) : John H. Culling

It is certified that error appears in the above-identified patent and that said Letters Patent are hereby corrected as shown below:

Abstract, line 13, "weightsilicon" should read -- weight silicon --. Column 6, line 34, "0.64% required" should read -- 0.64% is required --. Column 9, line 48, "Schrarfstein" should read -- Scharfstein --. Column 10, line 1 of heading in Table IV, "(I.P.V.)" should read -- (I.P.Y.) --. Column 11, line 1 of heading of Table IV-continued, "(I.P.V)" should read -- (I.P.Y.) --; column 11, Table IV-continued, under the heading "Alloy Number or Name", "ILLUM" should read -- ILLIUM --. Column 11, Table V, under the heading "Alloy Number or Name", "TLLTUM" should read -- ILLIUM --. Column 14, claim 4, line 17, "and" should read -- about --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*